United States Patent [19]

David

[11] 4,079,077

[45] Mar. 14, 1978

[54] CRATE

[76] Inventor: Pierre Alfred David, 18, Rue Jacquot-Defrance, 54520 Laxou, France

[21] Appl. No.: 640,904

[22] Filed: Dec. 15, 1975

[30] Foreign Application Priority Data

Dec. 19, 1974 France ..... 74 41974

[51] Int. Cl.[2] ..... B65D 21/02; B65D 21/04; B65D 7/20; B65D 1/38

[52] U.S. Cl. ..... 206/504; 206/507; 206/513; 206/518; 220/23.4

[58] Field of Search ..... 206/505, 507, 513, 518, 206/504, 505, 506, 507, 513, 518; 220/23.4

[56] References Cited

U.S. PATENT DOCUMENTS

| | | | |
|---|---|---|---|
| 3,200,988 | 8/1965 | Dechelbor | 220/21 |
| 3,327,889 | 6/1967 | Dore | 220/19 |
| 3,481,507 | 12/1969 | Sanders | 206/507 |
| 3,734,309 | 5/1973 | Bateman | 220/223.4 |
| 3,825,114 | 7/1976 | Johnson | 206/507 |
| 3,937,327 | 2/1976 | Carroll | 206/507 |

FOREIGN PATENT DOCUMENTS

| | | | |
|---|---|---|---|
| 920,626 | 3/1967 | United Kingdom | 206/505 |

*Primary Examiner*—George E. Lowrance
*Attorney, Agent, or Firm*—Holman & Stern

[57] ABSTRACT

The crate comprises an apertured bottom portion and inclined interconnected arms forming a succession of V-shaped structures connecting the outside of the bottom portion to a quadrangular upper girdle disposed outside the arms. The arms are in vertical planes and define at their interconnections horizontal top stops and bottom stops. Opposite sides of the crate have respectively upper reference members and lower reference members. The upper reference member overlaps the lower reference member of an adjacent crate when the adjacent crate has the same orientation as the first-mentioned crate and is correctly positioned relative to the latter to ensure that the pitch of the V-shaped structures is maintained across the joint between the crates.

10 Claims, 12 Drawing Figures

CRATE

The number of packages or crates employed and re-employed for transporting products, and more particularly food products, increases daily.

It is known to employ for this purpose apertured or open-work crates which are open on the top side and whose side walls are inclined so as to enable them to be fitted one inside the other when they are empty or stacked one on top of the other when they are full. But this arrangement increases the overall size of the crates and does not lend itself well to the storage within the crates of several layers of boxes or packages of geometric shape. Whereas such objects fully occupy the bottom layer of the crate, they are loosely packed in the upper layers which they fill imperfectly and in which they may move about and become damaged in the course of transport.

Other crates comprise vertical side walls formed by arms which are inclined in one direction and in the other and integral at their bottom with a bottom and at their top with an outer girdle. But this girdle increases their overall size and, when such crates, and in particular crates of different sizes, are stacked on the same platform, separate hooking means are required for holding the different stacks together and preventing them from moving with respect to each other or becoming overturned in the course of transport.

An object of the present invention is to provide crates of a novel shape which facilitates not only their filling, their fitting together and their stacking, but also their juxtaposition and their hooking, and the simultaneous use or re-use of a range of crates of different dimensions.

The present invention relates to crates which comprise between a bottom portion and a girdle arms which are inclined alternately in one direction and in the other in vertical planes and connected in pairs by horizontal portions constituting stops so as to form an uneven number of V-shaped structures the height H of which is equal to the vertical distance between the upper stops and the lower stops and the pitch P of which is equal to the horizontal distance between two successive upper or lower stops.

According to a main feature of the invention, the girdle of the crates has an overall size which is a multiple of the pitch of the V-shaped structures.

According to a preferred embodiment, the two opposed longitudinal or transverse sides of the girdle have complementary shapes and each may thus be put in superimposed relation to the complementary side of an adjacent crate, their effective overall size being less than their geometric overall size and being a multiple of half the pitch of the V-shaped structures. The crate thus has a reduced overall size but above all it may be easily and rapidly hooked to a neighbouring crate as soon as it is juxtaposed with the latter without the hooking elements increasing the total overall size.

According to another feature of the invention, the girdle is constituted on two halves of its perimeter by horizontal portions having different heights with respect to the bottom.

According to another feature of the invention, one of the upper and lower portions of the girdle carries projections and the other cavities which are oriented vertically at points at equal distances from median planes of the crate.

Moreover, the succession of V-shaped structures may be interrupted at opposite points of the crate to form handles.

Consequently, according to the invention, it is possible to construct crates of reduced overall size for a fixed capacity and combine the five advantages of being fittable one inside the other when empty, superimposable after re-orientation, hookable together in side-by-side relation, utilizable in combination in a plurality of dimensions, and easily handled.

The ensuing description of embodiments of the invention which are given merely by way of examples will reveal features and advantages of the invention.

Figure 1:
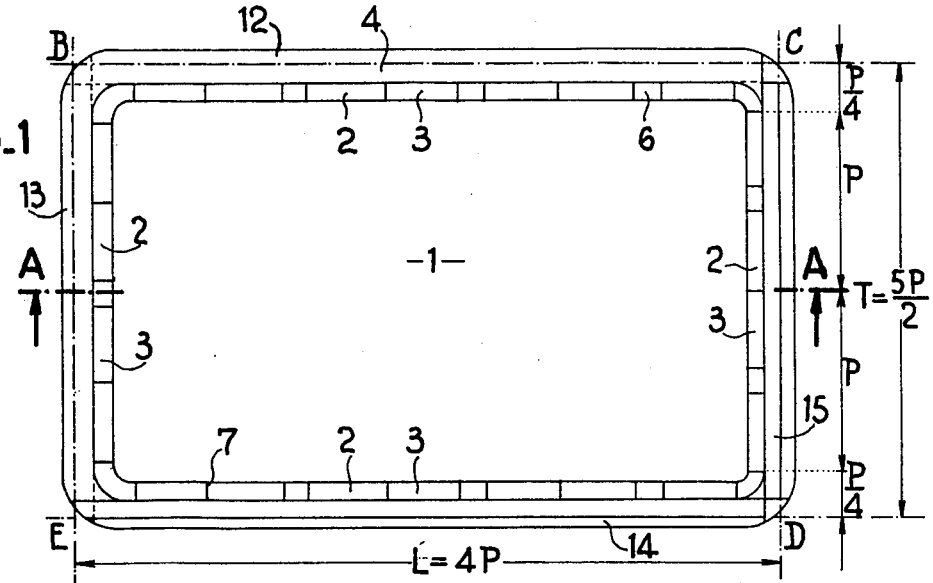
FIG. 1 is a plan view of a crate according to the invention.
Figure 2:
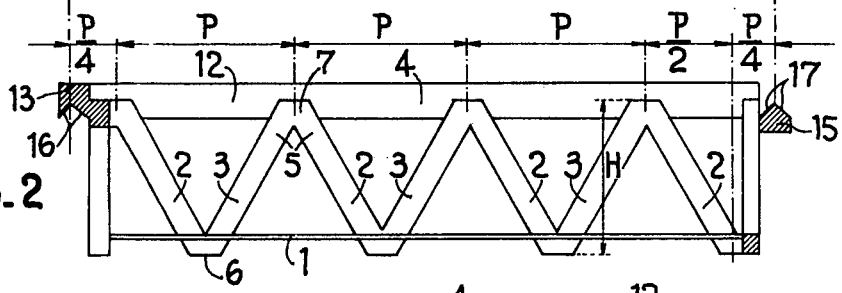
FIG. 2 is a vertical longitudinal sectional view taken on line A—A of FIG. 1.
Figure 3:
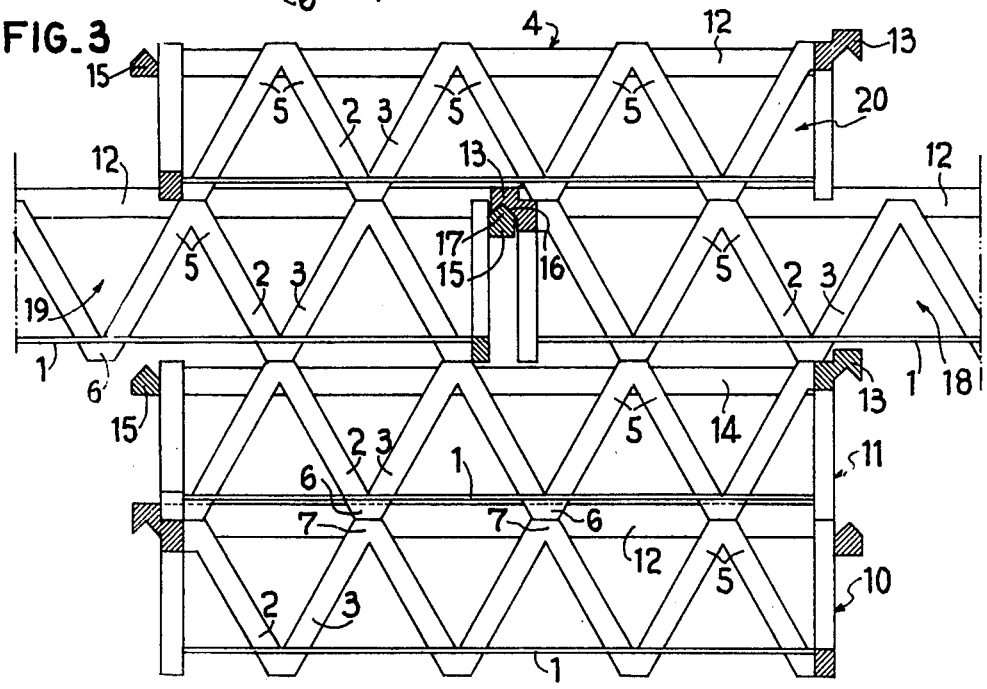
FIG. 3 is a vertical sectional view of an assembly of five crates similar to that shown in FIGS. 1 and 2 stacked in overlapping relation to each other in four layers.

In the embodiment shown in FIGS. 1 to 3, the crate according to the invention comprises a bottom portion or part 1, two series of arms 2 and 3 which are inclined in one direction and in the other and fixed in vertical planes around the bottom portion, and a girdle or belt 4 fixed to the outside of the arms. The assembly of the arms forms on the four sides of the crate a succession of V-shaped structures or chevrons 5 the bottom and top of which are horizontally truncated so as to form lower stops 6 and upper stops 7. The distance between the successive stops, or pitch P, of the V-shaped structures and the vertical distance between the lower and upper stops, or height H, of these structures are constant. The V-shaped structures are in an uneven number so that there corresponds to each lower stop 6 (FIG. 1) an upper stop 7 at an opposed point. It is thus possible to fit two or more crates together when they are in the same orientation or, on the other hand, to stack them one on the other when they are oriented in opposite directions, the upper stops 7 of a lower crate 10 then bearing against the lower stops 6 of an upper crate 11 (FIG. 3) which had been previously oriented in the opposite direction by a rotation through a half rotation about a vertical axis.

The girdle 4 (FIGS. 1 to 3) has four sides. Two consecutive sides 12 and 13 are fixed to the top of the V-shaped structures 5 and the other two consecutive sides 14 and 15 are fixed at a lower level slightly below these tops. The sides 12 and 13 have in their lower face a recess 16 of triangular cross-section (FIG. 2). The sides 14 and 15 have at their top a rib 17 of triangular cross-section located at the same level as the recess 16 with respect to the bottom portion 1. In this way the opposed sides 13 and 15 constitute upper reference means and lower reference means respectively and the opposed sides 12 and 14 constitute upper reference means and lower reference means respectively. Thus, when two crates 18 and 19 (FIG. 3) are disposed next to each other on the same level with the same orientation, the recess 16 of the upper side 13 of the girdle of the first crate 18 overlaps and fits over the rib 17 of the lower side 15 of the girdle of the second crate 19. Thus the crates according to the invention have the double advantage of being securely attached to each other in each layer of their assembly or loading and of having an effective overall size which is less than the sum of the individual geometric overall sizes of the crates constituting this assembly. The effective lateral overall size of a crate is indeed defined by the four vertical planes BC, CD, DE, EB (FIG. 1) passing through the hooking edges of the recesses 16 or ribs 17 of the corresponding sides of the girdle.

Further, on each of the longitudinal sides 12, 14 of the crate, the half arm or the end upper and lower stops *6a, 7a* is at a distance from the nearest plane CD or BE which is equal to one quarter of the pitch P of the V-shaped structures, the same being true of the transverse sides where the end V-shaped structures or stops are also at a distance equal to P/4 from the nearest plane BC or DE. Consequently, the longitudinal distance L between the planes CD and DE and the transverse distance T between the planes BC and CD are multiples of the half pitch P/2, at least one of these distances, on that one of the sides which must have an uneven number of half V-shaped structures, being itself an even multiple of P/2 and therefore a multiple of P.

For example, in the crate shown in FIG. 1, the longitudinal sides have three V-shaped structures and a half V-shaped structure and their distance L=4P, the transverse sides having two V-shaped structures and an distance T=5/2 P.

This feature has for effect that, when two crates 18 and 19 (FIG. 3) are placed end-to-end with the same orientation and with the upper reference means 13 of crate 18 overlapping and hooking onto the lower reference means 15 of crate 19 and with their sides 12 and 12 and 14 and 14 located in the extension of each other, the sum of their dimensions L is equal to an even number of half pitches and the rhythm of their V-shaped structures and corresponding stops is not interrupted at the joint between the two crates (see joint between crates 18 and 19 in FIG. 3).

Consequently, according to the invention, it is possible to juxtapose and stack crates 11, 18, 19, 20 having the same width but different lengths under the sole condition that they be oriented in the same direction and that the reference means overlap correctly and consequently one of their nearest stops is a lower stop and the other an upper stop.

This feature is particularly advantageous in the preparation of loads or assemblies comprising batches of crates of different dimensions.

According to the modification shown in FIG. 4, the girdle of the crates has a cross-section of an angle-member having a vertical flange 21 fixed to the V-shaped structures 22 and a horizontal flange 23, 24 which is disposed above the vertical flange 21 on the upper portions 12, 13 of the girdle and below this vertical flange on the lower portions 14 and 15.

Figure 4:
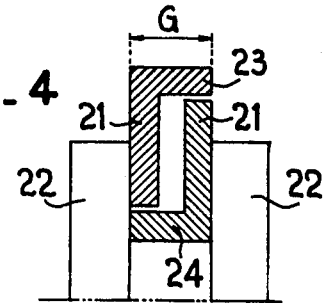
FIG. 4 is a partial vertical sectional view, in the region of their girdles, of two juxtaposed crates according to a modification of the invention.

The girdles of two juxtaposed crates may thus fit together as shown in FIG. 4. The upper horizontal flange 23 of a first crate passes above the vertical flange 21 of the girdle of the second neighbouring crate, and the lower horizontal flange 24 of the second crate slides under the vertical flange 21 of the first crate. The angle member 21, 23 constitutes upper reference means and the angle member 21, 24 constitutes lower reference means which latter are overlapped by the upper reference means when, and only when, two adjacent crates are in correct relationship as concerns both their relative position and their orientation.

Such an arrangement results in a saving in the longitudinal and transverse overall sizes of each crate, achieved on the pairs of opposed sides, equal to the width G of the upper flange of the girdle.

Figure 5:
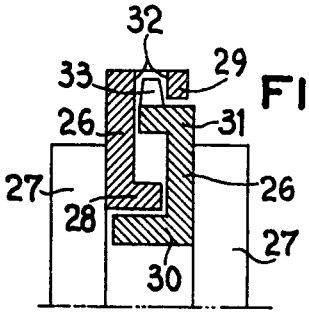
FIG. 5 is a view similar to FIG. 4 of two crates according to another modification, which are juxtaposed and hooked together.

The modification shown in FIG. 5 differs from the preceding embodiment in that the girdle of each one of the crates has not only a vertical flange 26 fixed to the V-shaped structures 27 and a horizontal flange 29, 30 located in the upper part of the vertical flange, but also a second horizontal flange 28, 31 which is smaller than the first-mentioned flange, extends in the same direction and is disposed at the opposite end of the vertical flange. The upper wide flange 29 of the upper portion of the girdle moreover has discontinuous apertures 32 and the narrow upper flange 31 of the lower portion of the girdle has discontinuous projections 33 each of which corresponds to an aperture placed at the same distance from the median planes of the crate. When crates are arranged in side-by-side relation with the same orientation in a common horizontal plane, the flange 29 overlaps the flange 31 and each of the projections 33 of one crate enters an aperture 32 of the girdle of the neighbouring crate so that the crates are hooked together in the correct position and the pitch of the V-shaped structures of the two crates across the joint between the crates is maintained.

This arrangement therefore ensures both a reduction in the overall size of the crates and their hooking together in the correct relative position. The apertures 32 and the projections 33 are preferably spaced from each other a distance equal to the pitch P of the V-shaped structures, or of a sub-multiple of this pitch, so that it is possible to interconnect by their girdles crates having different lengths or crates which are laterally offset from each other.

The crates described hereinbefore may be manufactured from various materials, and in particular injected plastics material of relatively low strength. The component elements of these crates, namely the V-shaped structures, girdle and bottom portion are then constructed with sufficiently large sections so that these crates may give long service in a fully satisfactory manner.

The invention also applies to crates manufactured from very strong materials, such as sheet metal or metal wire.

Figure 6:
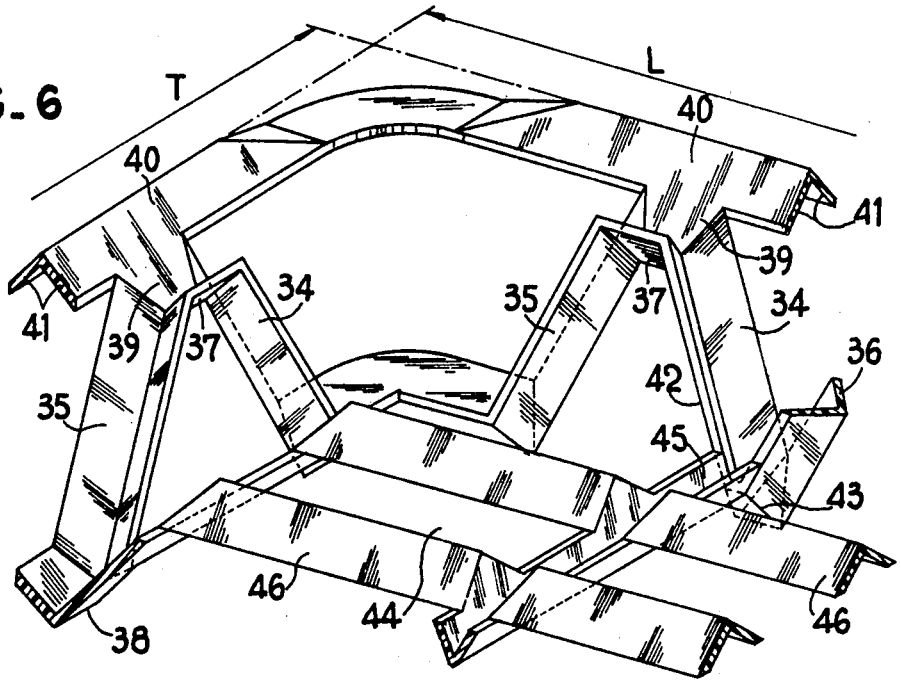
FIG. 6 is a partial perspective view of the corner of a crate whose component elements are in the form of angle-members.
Figure 7:
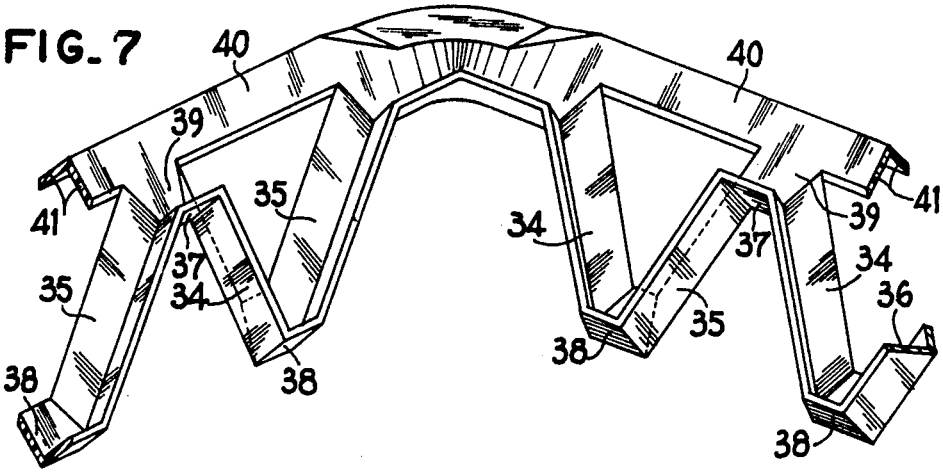
FIG. 7 is a partial sectional view of an opposite corner of the crate shown in FIG. 6, the bottom portion having been omitted.

Thus, FIGS. 6 and 7 show two opposite corners of a crate which is preferably constructed from blanked and pressed thin sheet metal. This crate comprises two series of inclined arms 34 and 35 which constitute V-shaped structures or chevrons and each have a section 36 of an angle-member having a vertical plane of symmetry. The successive arms are interconnected at their bottom or at their top by horizontal portions 37 and 38 constituting stops whose section is advantageously in the form of an angle-member having a vertical plane of symmetry. The outer flange 39 of the upper stop is integral with the inner flange 40 of the girdle 41 which is also in the shape of an angle-member having a vertical plane of symmetry. The inner flange 42 of the lower stops 43 is integral with the bottom portion 44 of the crate. This bottom portion is constituted by transverse angle-members 45 which bear on two facing lower stops 43 of two opposite sides of the crate and carry a series of longitudinal angle-members 46 defining therebetween a space if it is necessary to ensure a ventilation of the contents of the crate.

The girdle angle-members of the opposite sides of the crate may be offset in height by a distance equal to the thickness of the sheet metal; however, this offsetting may be neglected if it is less than the capacity of elastic deformation of the angle-member or less than the unevenness of the platform on which the crates are juxtaposed.

The angle-member shapes of the two opposite sides of the girdle are in any case complementary and permit a superimposition and interfitting of each one thereof with the complementary side of a neighbouring crate so that, in the same way as for the previously-described crate, the effective overall size of each crate is less than its geometric overall size. Moreover, the longitudinal effective overall size L and transverse effective overall size T of the crate is a multiple of the half pitch P/2 of the V-shaped structures, and at least one of these overall sizes is a multiple of the pitch P.

As explained hereinbefore, when two crates which have a longitudinal overall size which is a multiple of the pitch of their V-shaped structures are juxtaposed, with the same orientation, on the sides of these crates located in the extension of each other the rhythm of the V-shaped structures is continuous and this considerably facilitates the stacking.

Figure 8:
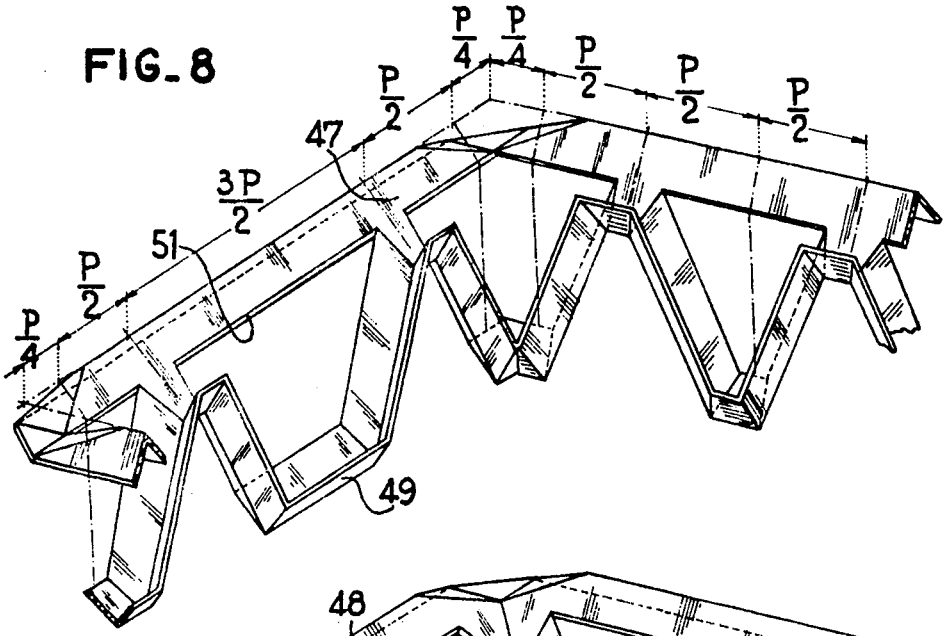
FIGS. 8 and 9 are partial perspective views of opposite sides of a similar crate provided with handles on its sides.
Figure 9:
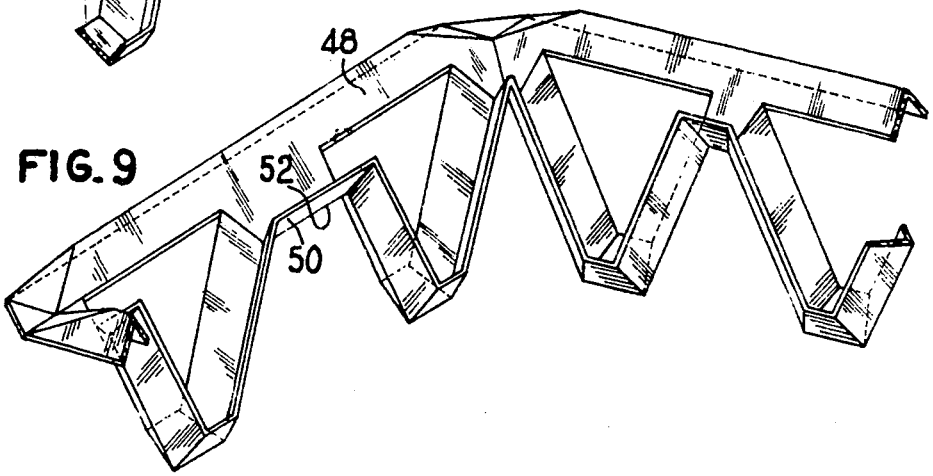

However, it may be desirable for certain loads to employ crates ensuring this continuity of the V-shaped structures in both the longitudinal and transverse direction. The overall size of each one of the four sides of such crates is a multiple of the pitch P and the perimeter corresponds to an even number of pitches P. Now, the total number of V-shaped structures of a crate must be an uneven number if it is to be capable of being stacked. The embodiment of the invention shown in FIGS. 8 and 9 permits conciliating these two conditions of an even parameter and an uneven number of V-shaped structures. These FIGS. 8 and 9 show (the bottom portion of the crate having been omitted) the opposite corners of such a crate which are preferably constructed from blanked and press-formed sheet metal. In this embodiment, two opposite sides 47 (FIG. 8) and 48 (FIG. 9) of the crate have an overall size which is a multiple of the pitch and have an even number of V-shaped structures. On these two sides, a lower stop 49 (FIG. 8) located in the middle of the side 47, and an upper stop 50 (FIG. 9) located in the middle of the opposite side 48, are extended by a length equal to a half-pitch. This arrangement also affords the advantage of forming in the middle of the girdles of the two opposite sides of the crate handles 51 and 52 which facilitate grasping and handling the crate.

Figure 10:
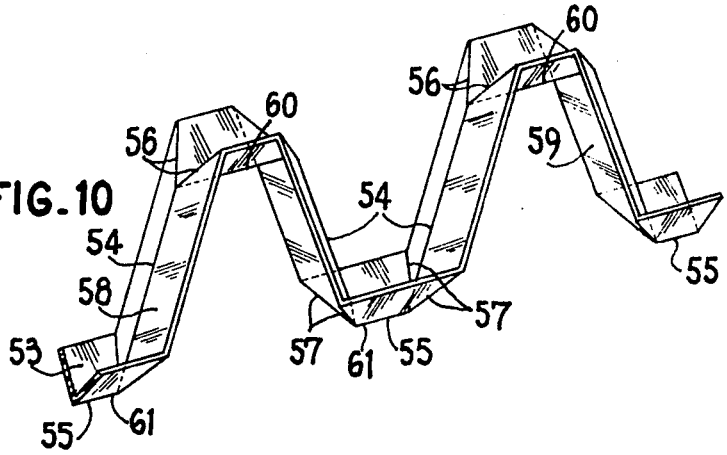
FIG. 10 is a perspective view of the V-shaped structures of folded metal of the lateral walls of the crates shown in FIGS. 6 to 9, and FIGS. 11 and 12 are partial perspective views of opposite corners of a wire crate according to another modification of the invention.

The embodiments shown in FIGS. 6 to 9 may be manufactured by press-forming sheet metal if the height H of the V-shaped structures and the corresponding elongation of their material does not exceed the possibility of deformation of this material. Otherwise, and in particular if the crates must be very deep, a modification may consist in cutting out the bottom portion and the girdle preferably from a single metal sheet having outside dimensions which correspond to those of the girdle, the bottom portion being located inside this girdle; they are thereafter interconnected by separately prepared V-shaped structures. FIG. 10 shows in perspective such V-shaped structures obtained by folding a sheet metal strip 53 along longitudinal folds 54 and 55 and along oblique folds 56 and 57 so as to constitute arms some of which, 58, are inclined in one direction and others, 59, in the other direction and are interconnected by stops 60 and 61. Each of these elements, namely arms and stops, has a section of an angle-member having a vertical plane of symmetry, the corner edge of this angle-member facing upwardly in the arms 58 and 59 and downwardly in the stops 60 and 61 or vice-versa.

Such V-shaped structures may be easily fixed to a girdle which is also in form of an angle-member and has either a vertical plane of symmetry or vertical and horizontal flanges, or even to a girdle of some other shape.

Figure 11:
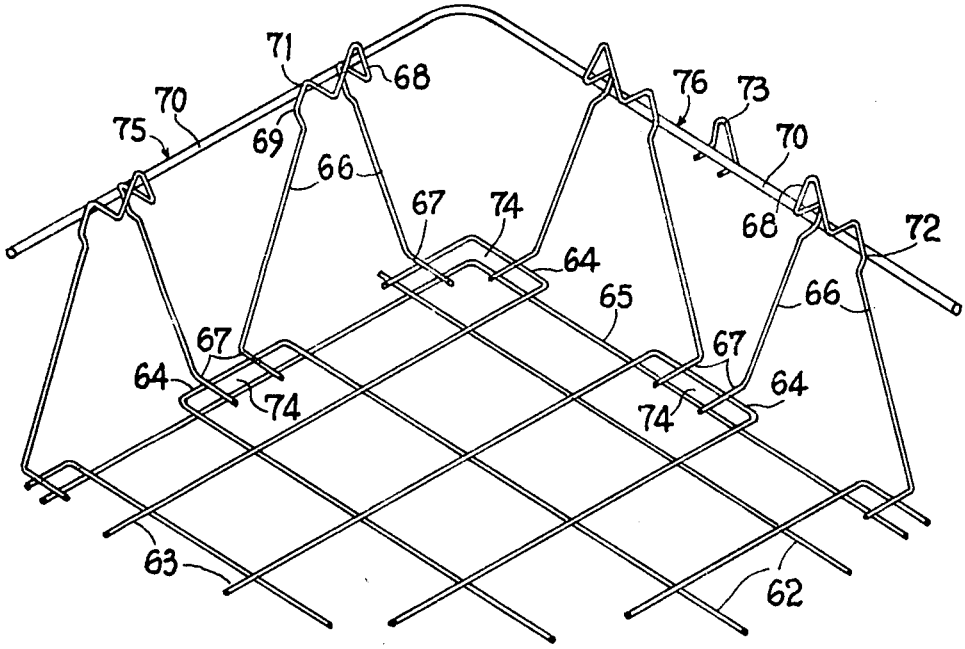
Figure 12:
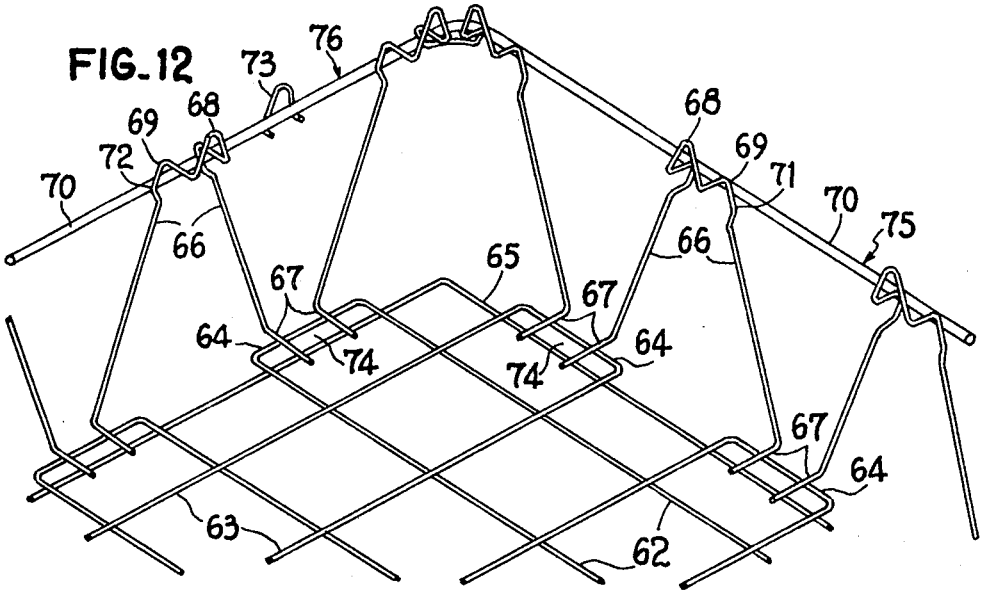

In another modification of the invention, the crate is constructed from rigid metal wires which are welded together at their crossing points. FIGS. 11 and 12 show opposite corners of a crate of this type. In these Figures, the bottom portion of the crates is constituted by a double network of longitudinal wires 62 and transverse wires 63 which are folded twice at their ends so as to form loops 64. The network is reinforced by a continuous or closed wire frame 65. This frame 65 and each one of the loops 64 carry wires in the shape of V-shaped structures 66 which are folded at their base 67 so as to be fixed to the frame 65 and loop 64 and define with the latter a lower stop and doubly folded at their top so as to constitute a hook 68. The base of the hooks is slightly outwardly offset at 69 and this offset portion is welded to a girdle 70 constituted by a wire whose diameter is preferably greater than that of the wire of the V-shaped structures. On the two sides 75 of the crate (FIG. 11), the girdle wire 70 is welded to the upper part 71 of the offset portions 69. On the other two sides 76, this wire is welded to the lower part 72 of the offset portions. Thus the higher portion of the girdle wire 70 on sides 75 constitutes an upper reference means and the lower portion of the girdle wire 70 on sides 76 constitutes a lower reference means. The lower portions of the girdle carry hooks 73 on the outside, these hooks projecting upwardly. When two crates are juxtaposed, as the girdle wires of their adjacent sides are at different heights, these wires can be overlap inside the hooks 73, which reduces the overall size of their assembly and hooks them together.

It will be understood that there is an uneven number of V-shaped structures of chevrons in each crate so that the crates may be fitted one inside the other if they are oriented in the same direction or stacked on each other if they are oriented in opposite directions, each hook 68 of the lower crate entering the ring 74 formed in the bottom portion of the upper crate by the frame 75, the loop 64 and the bottoms 67 of two consecutive V-shaped structures 66.

The crates described and illustrated hereinbefore are preferably made from a single material but it will be understood that they may also be made from two or more different materials and include, for example, metal arms or V-shaped structures having sufficient strength to support the load of a series of fully-stacked crates, and a bottom portion and a girdle of injected plastics material.

Having now described my invention what I claim as new and desire to secure by Letters Patent is:

1. A four-sided open-work crate comprising in combination a quadrangular bottom part, series of arms fixed to the outside of the bottom part and extending in a first, second, third and fourth vertical plane in inclined directions in said four planes and constituting a number of interconnected V-shaped structures and inverted V-shaped structures, said structures defining upwardly facing upper stops at interconnected upper ends of said arms and downwardly facing lower stops at interconnected lower ends of said arms, said stops of said structures in opposed first and third of said planes having identical pitches but the stops of the first plane being staggered relative to the stops of the third plane by half a pitch and said stops of said structures in opposed second and fourth of said planes having identical pitches but the stops of the second plane being staggered relative to the stops of the fourth plane by half a pitch whereby, when the crate is placed in vertical alignment with and on top of a subjacent identical crate having the same orientation as the crate in a horizontal plane, the lower stops of the crate are capable of bearing against and being supported by the upper stops of the subjacent crate whereas, when the subjacent crate has an opposite orientation in said horizontal plane, the V-shaped structures are capable of nesting in the V-shaped structures of the subjacent crate in said first, second, third and fourth planes, a four-sided upper girdle secured to the outside of said arms adjacent said upper ends of said arms and having a first, second, third and fourth side respectively pertaining to said first, second, third and fourth vertical planes, at least said first and third girdle sides defining reference means, said first girdle side defining lower reference means and said third girdle side defining upper reference means higher than the lower reference means, said upper and lower reference means having such relative positions laterally and vertically of the crate and the upper and lower reference means defining surfaces having such relative shapes that if the crate is assembled with two adjacent identical crates in a common horizontal plane so that the second and fourth vertical planes of the three crates are in common vertical planes, said surface of the lower reference means of the crate is capable of being overlapped by and substantially fitting with said surface of the upper reference means of one of the adjacent crates and said surface of the upper reference means of the crate is capable of overlapping and substantially fitting with said surface of the lower reference means of the other of the adjacent crates when, and only when, the crates are not only in said common plane but the pitches of the lower stops and upper stops of the three crates are maintained from one crate to the other in said second and fourth vertical planes of the crates so that it is possible to place the lower stops of the three assembled crates on top of upper stops of subjacent identical crates whereas when said adjacent crates have an opposite orientation to the crate in said common horizontal plane said surfaces of the upper and lower reference means are incapable of substantially fitting together in overlapping relationship and are thereby capable of precluding correct assembly of the three crates in a common horizontal plane.

2. A crate as claimed in claim 1, comprising further upper and lower reference means defined by said second and fourth girdle sides and having such relative positions laterally and vertically of the crate and defining surfaces having such relative shapes that said further reference means have the same capabilities as the reference means of the first and third girdle sides for ensuring assembly of three crates in a common horizontal plane with maintenance of the pitches of the stops in the second and fourth vertical planes.

3. A crate as claimed in claim 1, wherein said reference means extend substantially throughout the length of the corresponding side of the girdle.

4. A crate as claimed in claim 1, wherein said upper reference means has an inverted L-shaped cross-section and said lower reference means has a cross-section in the shape of an L in reverse in a plane perpendicular to said third and first vertical planes.

5. A crate as claimed in claim 1, wherein said first and third girdle sides each have a vertical flange fixed to said structures and at least one outwardly extending horizontal flange at the upper end of the vertical flange, apertures being provided in the horizontal flange of one of the first and third girdle sides whereas the horizontal flange of the other of the first and third girdle sides carries projections which are capable of entering the apertures when the reference means correctly overlap.

6. A four-sided open-work crate comprising in combination a quadrangular bottom part, series of arms fixed to the outside of the bottom part and extending in a first, second, third and fourth vertical plane in inclined directions in said four planes and constituting a number of interconnected V-shaped structures and inverted V-shaped structures, said structures defining upwardly facing upper stops at interconnected upper ends of said arms and downwardly facing lower stops at interconnected lower ends of said arms, said stops of said structures in opposed first and third of said planes having identical pitches but the stops of the first plane being staggered relative to the stops of the third plane by half a pitch and said stops of said structures in opposed second and fourth of said planes having identical pitches but the stops of the second plane being staggered relative to the stops of the fourth plane by half a pitch whereby, when the crate is placed in vertical alignment with and on top of a subjacent identical crate having the same orientation as the crate in a horizontal plane, the lower stops of the crate are capable of bearing against and being supported by the upper stops of the subjacent crate whereas, when the subjacent crate has an opposite orientation in said horizontal plane, the V-shaped structures are capable of nesting in the V-shaped structures of the subjacent crate in said first, second, third and fourth planes, a four-sided upper girdle secured to the outside of said arms adjacent said upper ends of said arms and having a first, second, third and fourth side respectively pertaining to said first, second, third and fourth vertical planes, at least said first and third girdle sides defining reference means, said first girdle side defining lower reference means and said third girdle side defining upper reference means higher than the lower reference means, said upper and lower reference means having such relative positions laterally and vertically of the crate and the upper and lower reference means defining surfaces having such relative shapes that if the crate is assembled with two adjacent identical crates in a common horizontal plane so that the second and fourth vertical planes of the three crates are in common vertical planes, said surfaces of the lower reference means of the crate is capable of being overlapped by and substantially fitting with said surface of the upper reference means of one of the adjacent crates and said surface of the upper reference means of the crate is capable of overlapping and substantially fitting with said surface of the lower reference means of the other of the adjacent crates when, and only when, the crates are not only in said common plane but the pitches of the lower stops and upper stops of the three crates are maintained from one crate to the other in said second and fourth vertical planes of the crates so that it is possible to place the lower stops of the three assembled crates on top of upper stops of subjacent identical crates whereas when said adjacent crates have an opposite orientation to the crate in said common horizontal plane said surfaces of the upper and lower reference means are incapable of substantially fitting together in overlapping relationship and are thereby capable of precluding correct assembly of the three crates in a common horizontal plane, said surfaces of said reference means being capable of interlocking when in overlapping relation so as to prevent separation of the laterally adjacent crates in said common plane.

7. A crate as claimed in claim 6, wherein said reference means have complementary inverted substantially V-shaped cross sections in a plane perpendicular to said first and third vertical planes.

8. A crate as claimed in claim 6, wherein one of said reference means comprise cavities in said girdle and the other said reference means comprise projections on said girdle, the projections and cavities being capable of interengaging when said reference means overlap.

9. A crate as claimed in claim 8, wherein the projections and the cavities are discontinuous and repeated at distances apart equal to the pitch of said stops of said structures in said first and third planes.

10. A crate as claimed in claim 8, wherein the projections and the cavities are discontinuous and repeated at distances apart equal to sub-multiples of the pitch of said stops of said structures in said first and third planes.

* * * * *